US009843119B1

(12) United States Patent
Chen

(10) Patent No.: US 9,843,119 B1
(45) Date of Patent: Dec. 12, 2017

(54) HIGH SPEED CONNECTOR ASSEMBLY, RECEPTACLE CONNECTOR AND RECEPTACLE TERMINAL

(71) Applicant: OUPIIN ELECTRONIC (KUNSHAN) CO., LTD, Kunshan, Jiangsu (CN)

(72) Inventor: Hsin Chih Chen, Jiangsu (CN)

(73) Assignee: OUPIIN ELECTRONIC (KUNSHAN) CO., LTD, Kunshan (CN)

( * ) Notice: Subject to any disclaimer, the term of this patent is extended or adjusted under 35 U.S.C. 154(b) by 0 days.

(21) Appl. No.: 15/412,073

(22) Filed: Jan. 23, 2017

(30) Foreign Application Priority Data

Jun. 8, 2016 (CN) ..... 2016 1 0400230

(51) Int. Cl.
*H01R 4/66* (2006.01)
*H01R 13/11* (2006.01)
*H01R 13/514* (2006.01)

(52) U.S. Cl.
CPC ..... *H01R 13/112* (2013.01); *H01R 13/113* (2013.01); *H01R 13/514* (2013.01)

(58) Field of Classification Search
CPC ..... H01R 23/688; H01R 4/64; H01R 13/432; H01R 13/112; H01R 13/113
USPC ..... 439/101, 108, 92, 857, 856, 862, 748
See application file for complete search history.

(56) References Cited

U.S. PATENT DOCUMENTS 6,123,586 A * 9/2000 MacDougall ..... H01R 13/506 439/701
6,227,882 B1 * 5/2001 Ortega ..... H01R 23/688 439/101
6,343,955 B2 * 2/2002 Billman ..... H01R 13/2414 439/101
6,517,360 B1 * 2/2003 Cohen ..... H01R 23/688 439/607.11
6,652,318 B1 * 11/2003 Winings ..... H01R 13/6471 439/607.07
6,695,627 B2 * 2/2004 Ortega ..... H01R 13/04 439/108

* cited by examiner

*Primary Examiner* — Phuong Chi T Nguyen
(74) *Attorney, Agent, or Firm* — Soroker Agmon Nordman

(57) ABSTRACT

A high speed connector assembly is disclosed in this invention, which includes a receptacle connector and a plug connector. The receptacle connector at least includes an insulating cover and multiple terminal modules being arranged in parallel and retained in the insulating cover. Each differential signal terminal has an L-type base, a front mating portion and a bottom mounting portion. The front mating portion includes a finger-shaped spring and an L-type contact piece. When the receptacle connector and the plug connector are engaged, the finger-shaped spring and the L-type contact piece can respectively and electrically contact with two different surfaces of one plug terminal to form double contacts. The double contacts can suppress the short pile effect and reduce signal crosstalk and signal loss during transmitting the high speed signal.

11 Claims, 6 Drawing Sheets

HIGH SPEED CONNECTOR ASSEMBLY, RECEPTACLE CONNECTOR AND RECEPTACLE TERMINAL

BACKGROUND OF THE INVENTION

1. Field of the Invention

The present invention relates to a connector technology, and more particularly to a high speed connector assembly, a receptacle connector and a receptacle terminal, which can provide double contacts.

2. Description of the Prior Art

In the electronics industry, a right-angle high speed connector assembly can provide a connection interface for multiple circuit boards. For example, it can connect two orthogonal circuit boards to shorten the signal transmission channel length of these systems and improve the channel performance of signal integrity.

The high speed connector assembly is one common connector, which is used for large scale communication equipment, a super high performance server, a huge computer, an industrial computer and a high end storage device. This highly flexible high performance connector has become an ideal choice for telecommunications and data network applications.

However, it is a very important issue how to provide greater throughput and ensure more stable and reliable signal transmission by changing the signal transmission path between a receptacle connector and a plug connector under the condition of no redesign to above connection.

BRIEF SUMMARY OF THE INVENTION

One object of the present invention is to provide a high speed connector assembly, which comprises a receptacle connector and a plug connector, wherein each receptacle terminal can contact with two different surfaces of one corresponding plug terminal to form double contacts, thereby restraining the short pile effect and reducing the crosstalk and loss at high speed signal transmission.

The other object of the present invention is to provide a receptacle connector, each receptacle terminal of which can contact with two different surfaces of one corresponding plug terminal to form double contacts, thereby restraining the short pile effect and reducing the crosstalk and loss at high speed signal transmission.

Another object of the present invention is to provide a receptacle terminal, which can contact with two different surfaces of one corresponding plug terminal to form double contacts, thereby restraining the short pile effect and reducing the crosstalk and loss at high speed signal transmission.

Other objects and advantages of the present invention may be further understood from the technical features disclosed by the present invention.

To achieve the aforementioned object or other objects of the present invention, the present invention adopts the following technical solution.

The present invention provides a high speed connector assembly, which comprises a receptacle connector and a plug connector. The receptacle connector includes at least an insulating cover and multiple terminal modules fixed by the insulating cover and arranged in parallel. Each terminal module includes an insulating frame and a receptacle terminal group retained in the insulating frame. The receptacle terminal group includes multiple pairs of differential signal terminals and multiple grounding terminals, and these terminals of the receptacle terminal group are located in a same vertical plane. Each differential signal terminal has an L-type base, a front mating portion extending forward from one end of the base, and a bottom mounting portion extending downward from the other end of the base. The front mating portion includes a finger-shaped spring extending forward and an L-type contact piece extending forward. The finger-shaped spring has a convex portion being perpendicular to the vertical plane, and the L-type contact piece has a horizontal extension portion being perpendicular to the vertical plane. The plug connector includes multiple plug terminals. When the receptacle connector and the plug connector are electrically engaged with each other, the convex portion of the finger-shaped spring and the horizontal extension portion of the L-type contact piece can electrically contact with different surfaces of one corresponding plug terminal.

In one embodiment, the finger-shaped spring and the L-type contact piece are independent of each other and are separated along a vertical direction, and the length of the L-type contact piece is larger than that of the finger-shaped spring.

In one embodiment, the finger-shaped spring further has a straight section located in the vertical plane and connected to the base, and a tilted section leaving the vertical plane and being connected to the straight section. The convex portion is formed on the front of the tilted section. And the L-type contact piece further has a straight portion connected to the base. The horizontal extension portion is formed on the front of the straight portion.

In one embodiment, each pair of differential signal terminals includes two differential signal terminals, the front mating portions of which are symmetrically to each other; there are two grounding terminals respectively arranged on two sides of each pair of differential signal terminals; and the width of each grounding terminal is larger than that of each differential signal terminal.

In one embodiment, each plug terminal has a straight mating part with a rectangular cross section, the straight mating part includes a wide surface and a narrow surface connected to the wide surface and perpendicular to the wide surface; when the receptacle connector and the plug connector are electrically engaged with each other, the convex portion of the finger-shaped spring can electrically contact with the wide surface, and the horizontal extension portion of the L-type contact piece can electrically contact with the narrow surface.

The present invention also provides a receptacle connector, which includes an insulating cover and multiple terminal modules fixed by the insulating cover and arranged in parallel. Each terminal module includes an insulating frame and a receptacle terminal group retained in the insulating frame. The receptacle terminal group includes multiple pairs of differential signal terminals and multiple grounding terminals, and these terminals of the receptacle terminal group are located in a same vertical plane. Wherein each differential signal terminal has an L-type base, a front mating portion extending forward from one end of the base, and a bottom mounting portion extending downward from the other end of the base. The front mating portion includes a finger-shaped spring extending forward and an L-type contact piece extending forward. The finger-shaped spring has a convex portion being perpendicular to the vertical plane, and the L-type contact piece has a horizontal extension portion being perpendicular to the vertical plane. When the receptacle connector is electrically engaged with a plug connector, the convex portion of the finger-shaped spring and the horizontal extension portion of the L-type contact piece can electrically contact with different surfaces of one same plug terminal of the plug connector.

The present invention further provides a receptacle terminal, which includes an L-type base located in a vertical plane, a front mating portion extending forward from one end of the base and a bottom mounting portion extending downward from the other end of the base. The front mating portion includes a finger-shaped spring extending forward and an L-type contact piece extending forward. Wherein the finger-shaped spring has a convex portion being perpendicular to the vertical plane, and the L-type contact piece has a horizontal extension portion being perpendicular to the vertical plane. When the receptacle terminal is electrically engaged with a plug terminal, the convex portion of the finger-shaped spring and the horizontal extension portion of the L-type contact piece can electrically contact with different surfaces of the plug terminal.

In comparison with the prior art, the high speed connector assembly of the present invention can form double contacts between the receptacle terminal and the plug terminal. By this electrical engagement, the high speed connector assembly of the present invention can restrain the short pile effect and reduce the crosstalk and loss when the transmission rate of the high speed signal is greater than 25 Gbps-40 Gbps.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "up", "down", "front", "back", "left", "right", "top", "bottom" etc., are only used with reference to the orientation of the accompanying drawings. Therefore, the used directional terms are intended to illustrate, but not to limit, the present invention.

Figure 1:
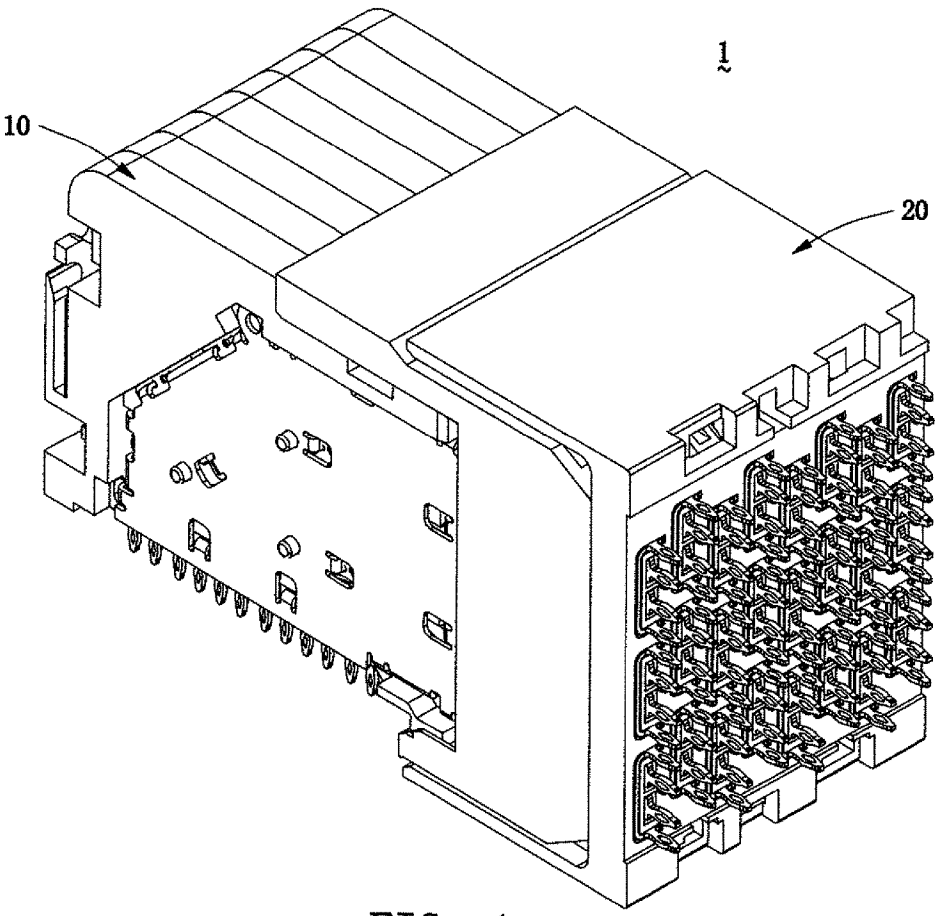
FIG. 1 is a perspective view of a high speed connector assembly of the present invention.
Figure 2:
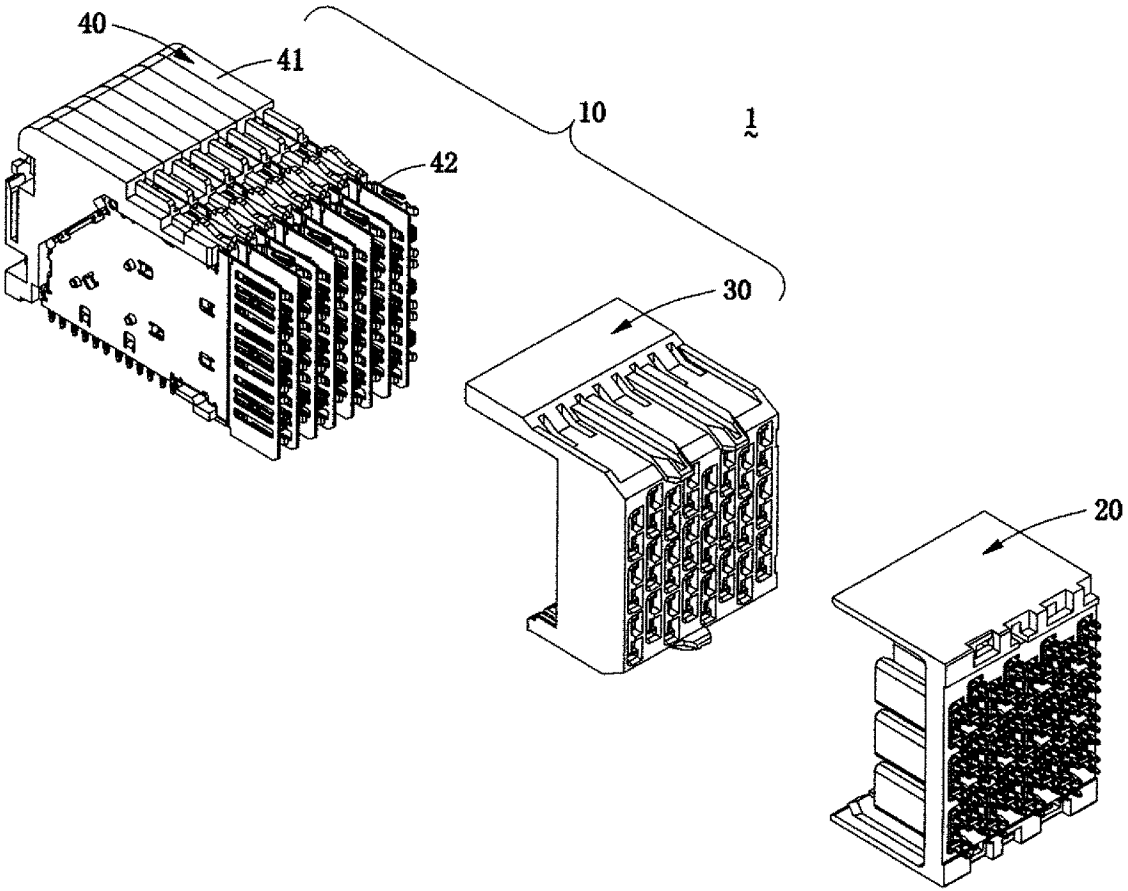
FIG. 2 is a disassembled view of the high speed connector assembly of the present invention.
Figure 3:
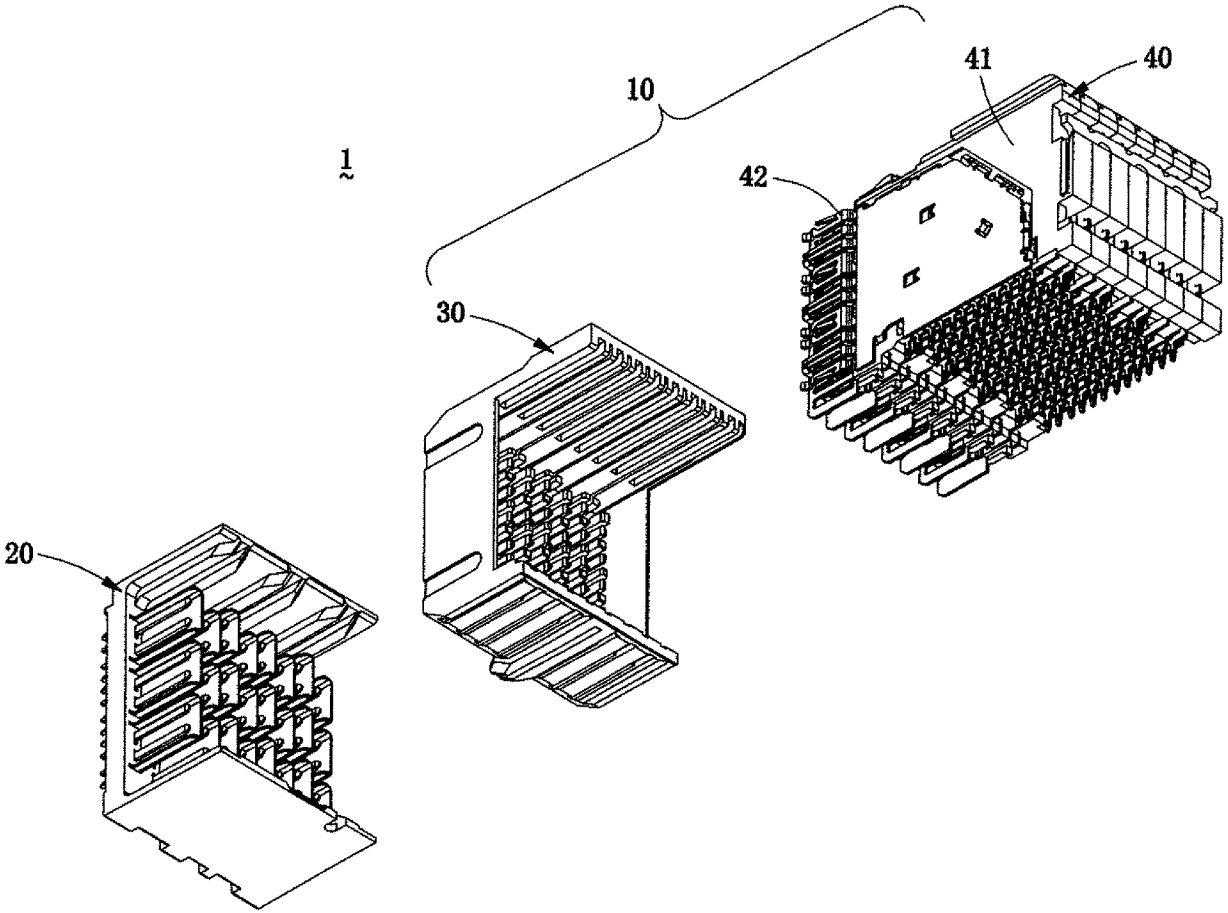
FIG. 3 is a disassembled view of the high speed connector assembly along another direction.

Please refer to FIGS. 1 to 3, a high speed connector assembly of the present invention includes a receptacle connector 10 and a plug connector 20. The receptacle connector 10 may be a right-angle connector, the mating direction of which is parallel to a horizontal circuit board (not shown), on which the receptacle connector 10 is mounted. The plug connector 20 may be a vertical end connector, the mating direction of which is perpendicular to a vertical circuit board (not shown), on which the plug connector 20 is mounted.

Please refer to FIGS. 2 and 3, the receptacle connector 10 includes at least an insulating cover 30 and multiple terminal modules 40 mounted in the insulating cover 30 and arranged in parallel from left to right. In the embodiment, the receptacle connector 10 of the present invention includes eight terminal modules 40. But in other embodiments, the number of the terminal modules 40 can be changed in order to increase the density of the receptacle connector 10. Each terminal module 40 includes at least an insulating frame 41 and a receptacle terminal group 42 retained in the insulating frame 41.

Figure 4:
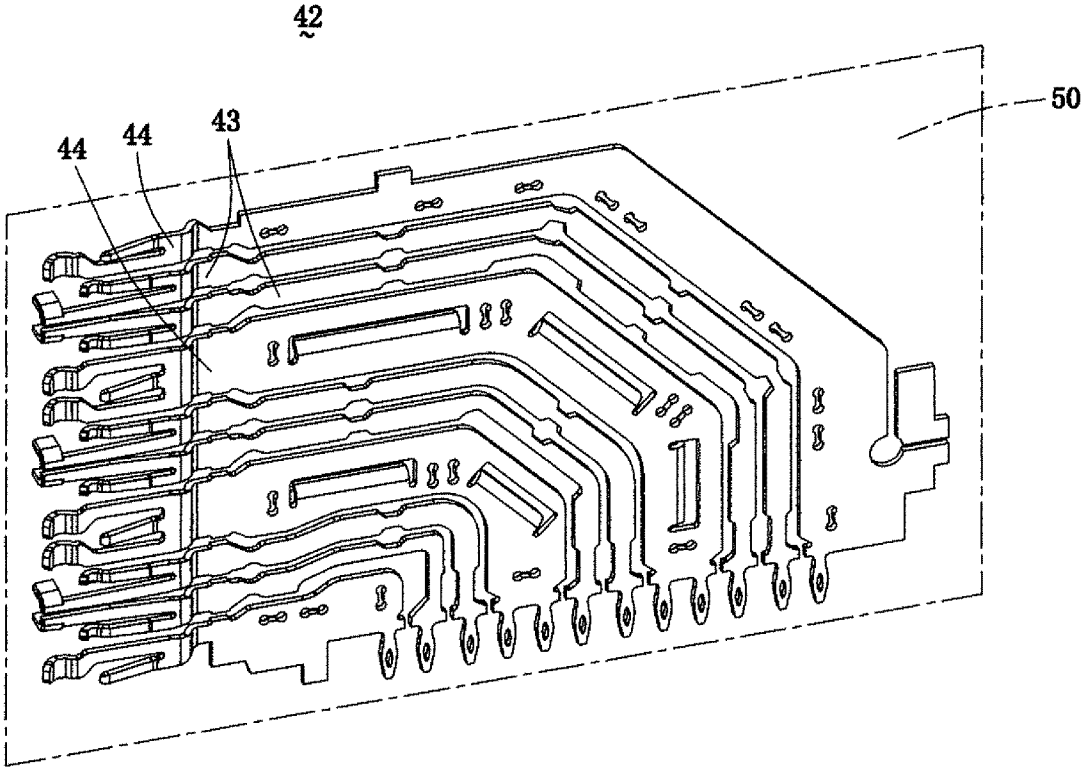
FIG. 4 is a perspective view of one receptacle terminal group of a receptacle connector of the present invention.

Please refer to FIG. 4, the receptacle terminal group 42 includes multiple pairs of differential signal terminals 43 and multiple grounding terminals 44. There are two grounding terminals 44 respectively arranged on two sides of each pair of differential signal terminals 43. In the embodiment, these differential signal terminals 43 and these grounding terminals 44 are located in a same vertical plane 50. Each pair of differential signal terminals 43 includes two differential signal terminals 43. The width of the grounding terminal 44 is larger than that of the differential signal terminal 43.

Figure 5:
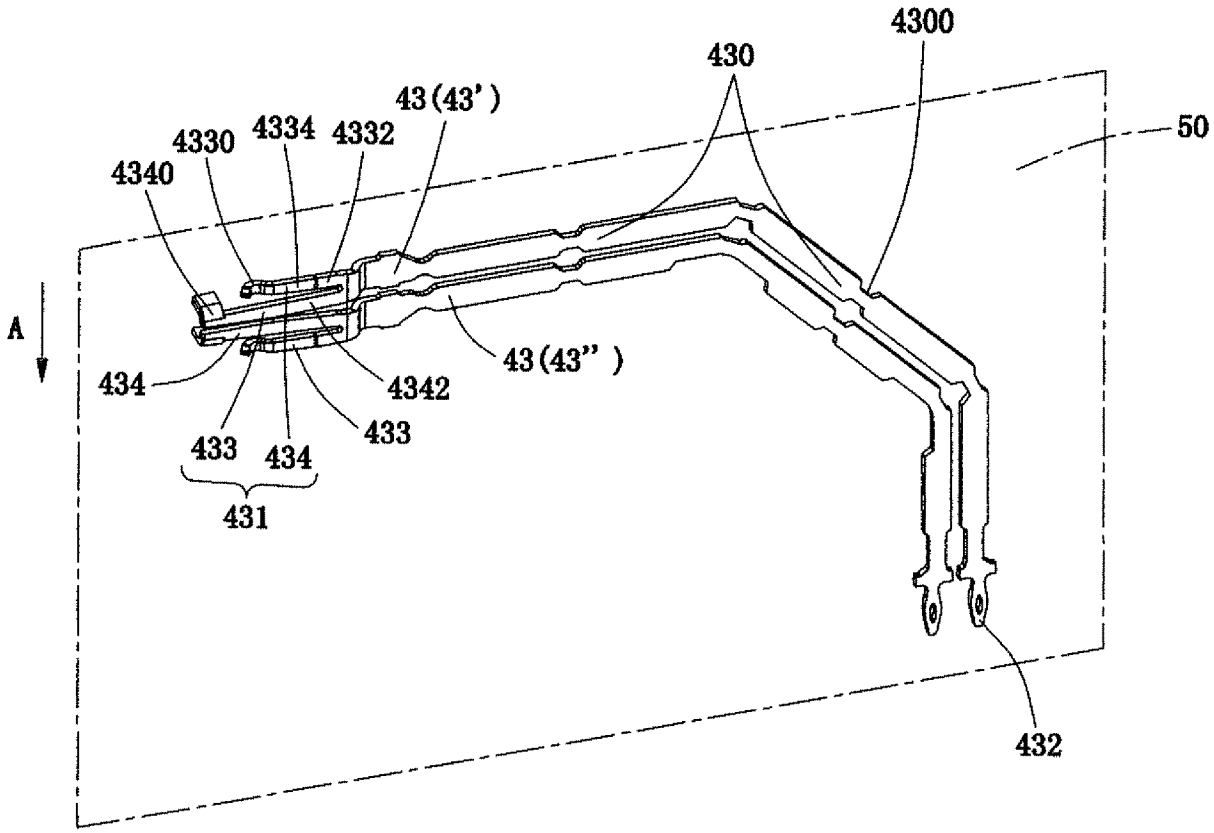
FIG. 5 is a schematic view of one pair of differential signal terminals in the receptacle terminal group shown by FIG. 4.

Please refer to FIG. 5, each differential signal terminal 43 has an L-type base 430, a front mating portion 431 extending forward from one end of the base 430, and a bottom mounting portion 432 extending downward from the other end of the base 430. The front mating portion 431 includes a finger-shaped spring 433 extending forward and an L-type contact piece 434 extending forward. The finger-shaped spring 433 has a convex portion 4330 being perpendicular to the vertical plane 50 for being engaged with a plug terminal 21 (seen in FIG. 6). The L-type contact piece 434 has a horizontal extension portion 4340 being perpendicular to the vertical plane 50 for being engaged with the same plug terminal 21 (seen in FIG. 6).

Referring to FIG. 5, in the embodiment, the finger-shaped spring 433 and the L-type contact piece 434 are independent of each other and are separated along a vertical direction A. The length of the L-type contact piece 434 is larger than that of the finger-shaped spring 433. The lengths of the L-type contact piece 434 and the finger-shaped spring 433 can be changed according to the actual needs of the electrical demand.

Referring to FIG. 5, in the embodiment, the finger-shaped spring 433 further has a straight section 4332 located in the vertical plane 50 and connected to the base 430, and a tilted section 4334 leaving the vertical plane 50 and being connected to the straight section 4332. The convex portion 4330 is formed on the front of the tilted section 4334. Actually, in other embodiment, the tilted section 4334 is not necessary, but can be omitted. Therefore, the convex portion 4330 may be directly disposed on the front of the straight section 4332 to realize the electrical contact between the finger-shaped spring 433 and the plug terminal 21.

Referring to FIG. 5, in the embodiment, the L-type contact piece 434 further has a straight portion 4342 connected to the base 430. The horizontal extension portion 4340 is formed on the front of the straight portion 4342.

Referring to FIG. 5, in one pair of differential signal terminals 43, the finger-shaped spring 433 of one differential signal terminal 43' is located above the L-type contact piece 434, and the finger-shaped spring 433 of the other differential signal terminal 43" is located under the L-type contact piece 434. In other words, the front mating portions 431 of the pair of differential signal terminals 43', 43" are symmetrically to each other.

Referring to FIG. 5, the base 430 has multiple notches 4300 on two opposite edges thereof to be used for regulating terminal impedance. The bottom mounting portion 432 is a needle shaped pin, which can be connected to a signal point of the horizontal circuit board.

Figure 6:
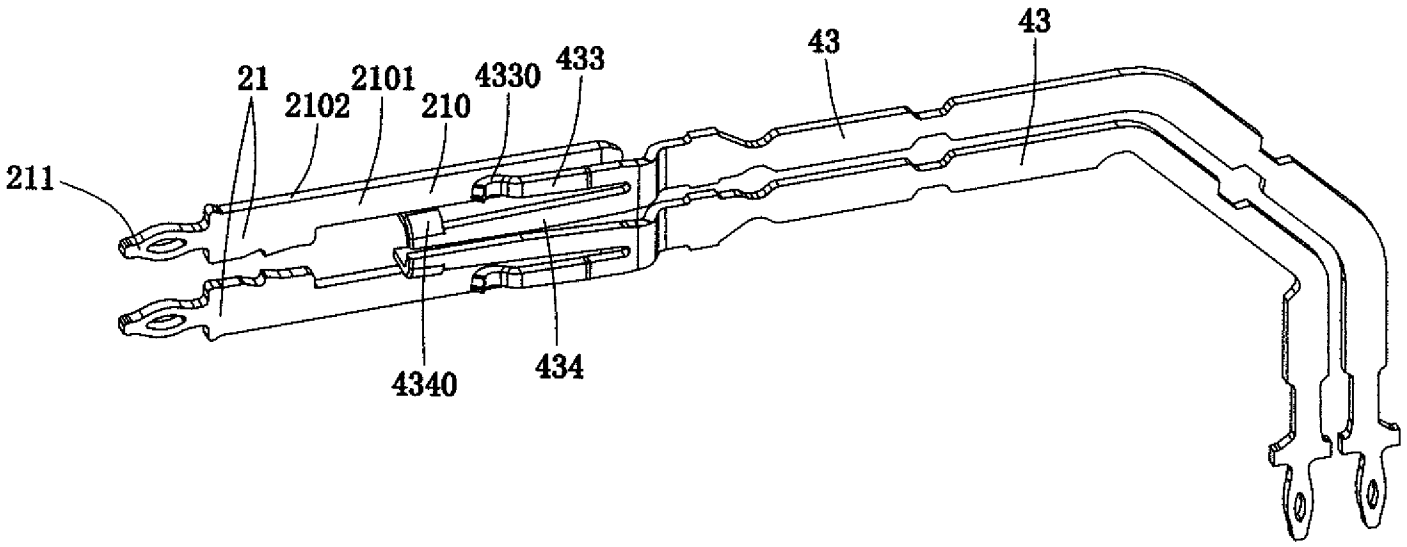
FIG. 6 is a simulation diagram showing the engagement of one pair of differential signal terminals and one pair of plug terminals.

Please refer to FIG. 6, each plug terminal 21 has a straight mating part 210 and a mounting end 211 connected to the straight mating part 210. The cross section of the straight mating part 210 is rectangular. The straight mating part 210 includes a wide surface 2101 and a narrow surface 2102 connected to the wide surface 2101 and perpendicular to the wide surface 2101. In the embodiment, the wide surface 2101 and the narrow surface 2102 are two different surfaces of the plug terminal 21. When the receptacle connector 10 and the plug connector 20 shown in FIG. 1 are electrically engaged with each other, the convex portion 4330 of the finger-shaped spring 433 slides toward the mounting end 211 along the wide surface 2101 and is finally pressed on the wide surface 2101, and the horizontal extension portion 4340 of the L-type contact piece 434 slides toward the mounting end 211 along the narrow surface 2102 and is finally pressed on the narrow surface 2102, whereby the pair of differential signal terminals 43 of the receptacle connector 10 can electrically contact with one corresponding pair of plug terminals 21.

As described above, the receptacle terminal (namely one differential signal terminal 43) of the receptacle connector 10 of the present invention can provide double contacts when being mated with the plug terminal 21. Specifically, one contact is formed between the convex portion 4330 and the wide surface 2101, and the other contact is formed between the L-type contact piece 434 and the narrow surface 2102. By this electrical engagement, the high speed connector assembly 1 of the present invention can restrain the short pile effect and reduce the crosstalk and loss when the transmission rate of the high speed signal is greater than 25 Gbps-40 Gbps.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A high speed connector assembly, which comprises:

a receptacle connector including at least an insulating cover and multiple terminal modules fixed by the insulating cover and arranged in parallel;

each terminal module including an insulating frame and a receptacle terminal group retained in the insulating frame; the receptacle terminal group including multiple pairs of differential signal terminals and multiple grounding terminals, and these terminals of the receptacle terminal group being located in a same vertical plane;

each differential signal terminal having an L-type base, a front mating portion extending forward from one end of the base, and a bottom mounting portion extending downward from the other end of the base;

the front mating portion including a finger-shaped spring extending forward from a main portion of a contact terminal;

the finger-shaped spring comprising two branches; the first branch is shorter than a second branch; the first branch having a convex portion extending perpendicular to the vertical plane to mate with a large surface of a mating contact of a plug connector; the large surface is parallel to the vertical plane and the second branch having an L-type contact piece extending perpendicular to the vertical plane to mate with a small surface of the mating contact, the small surface perpendicular to the vertical plane of the plug connector to restrict adjacent mating contacts of a plug connector;

the small surface is perpendicular to the larger surface of the mating contact of the plug connector; and the plug connector including multiple plug terminals;

when the receptacle connector and the plug connector are electrically engaged with each other, the convex portion of the finger-shaped spring of the L-type contact piece can electrically contact with different surfaces of one corresponding plug terminal.

2. The high speed connector assembly as claimed in claim 1, wherein the finger-shaped spring and the L-type contact piece are independent of each other and are separated along a vertical direction, and the length of the L-type contact piece is larger than that of the finger-shaped spring.

3. The high speed connector assembly as claimed in claim 1, wherein the finger-shaped spring further has a straight section located in the vertical plane and connected to the base, and a tilted section leaving the vertical plane and being connected to the straight section; the convex portion is formed on the front of the tilted section; and the L-type contact piece further has a straight portion connected to the base; the horizontal extension portion is formed on the front of the straight portion.

4. The high speed connector assembly as claimed in claim 1, wherein each pair of differential signal terminals includes two differential signal terminals, the front mating portions of which are symmetrically to each other; there are two grounding terminals respectively arranged on two sides of each pair of differential signal terminals; and the width of each grounding terminal is larger than that of each differential signal terminal.

5. The high speed connector assembly as claimed in claim 1, wherein each plug terminal has a straight mating part with a rectangular cross section, the straight mating part includes a wide surface and a narrow surface connected to the wide surface and perpendicular to the wide surface; when the receptacle connector and the plug connector are electrically engaged with each other, the convex portion of the finger-shaped spring can electrically contact with the wide surface, and the horizontal extension portion of the L-type contact piece can electrically contact with the narrow surface.

6. A receptacle connector, which includes:

an insulating cover; and multiple terminal modules fixed by the insulating cover and arranged in parallel;

each terminal module including an insulating frame and a receptacle terminal group retained in the insulating frame; the receptacle terminal group including multiple pairs of differential signal terminals and multiple grounding terminals, and these terminals of the receptacle terminal group being located in a same vertical plane;

wherein each differential signal terminal has an L-type base, a front mating portion extending forward from one end of the base, and a bottom mounting portion extending downward from the other end of the base;

the front mating portion including a finger-shaped spring extending forward from a main portion of a contact terminal;

the finger-shaped spring comprising two branches; the first branch is shorter than a second branch; the first branch having a convex portion extending perpendicular to the vertical plane to mate with a large surface of a mating contact of a plug connector; the large surface is parallel to the vertical plane and the second branch having an L-type contact piece extending perpendicular to the vertical plane to mate with a small surface of the mating contact, the small surface perpendicular to the vertical plane of the plug connector restrict adjacent mating contacts of a plug connector;

the small surface is perpendicular to the larger surface of the mating contact of the plug connector; and the plug connector including multiple plug terminals;

when the receptacle connector is electrically engaged with a plug connector, the convex portion of the finger-shaped spring of the L-type contact piece can electrically contact with different surfaces of one same plug terminal of the plug connector.

7. The receptacle connector as claimed in claim 6, wherein the finger-shaped spring and the L-type contact piece are independent of each other and are separated along a vertical direction, and the length of the L-type contact piece is larger than that of the finger-shaped spring.

8. The receptacle connector as claimed in claim 6, wherein the finger-shaped spring further has a straight section located in the vertical plane and connected to the base, and a tilted section leaving the vertical plane and being connected to the straight section; the convex portion is formed on the front of the tilted section; and the L-type contact piece further has a straight portion connected to the base; the horizontal extension portion is formed on the front of the straight portion.

9. A receptacle terminal including:

an L-type base located in a vertical plane;

the front mating portion including a finger-shaped spring extending forward from a main portion of a contact terminal;

the finger-shaped spring comprising two branches; the first branch is shorter than a second branch; the first branch having a convex portion extending perpendicular to the vertical plane to mate with a large surface of a mating contact of a plug connector; the large surface is parallel to the vertical plane and the second branch having an L-type contact piece extending perpendicular to the vertical plane to mate with a small surface of the mating contact, the small surface perpendicular to the vertical plane of the plug connector to restrict adjacent mating contacts of a plug connector;

the small surface is perpendicular to the larger surface of the mating contact of the plug connector; and a bottom mounting portion extending downward from the other end of the base;

when the receptacle connector and the plug connector are electrically engaged with each other, the convex portion of the finger-shaped spring of the L-type contact piece can electrically contact with different surfaces of one corresponding plug terminal.

10. The receptacle terminal as claimed in claim 9, wherein the finger-shaped spring and the L-type contact piece are independent of each other and are separated along a vertical direction, and the length of the L-type contact piece is larger than that of the finger-shaped spring.

11. The receptacle terminal as claimed in claim 9, wherein the finger-shaped spring further has a straight section located in the vertical plane and connected to the base, and a tilted section leaving the vertical plane and being connected to the straight section; the convex portion is formed on the front of the tilted section; and the L-type contact piece further has a straight portion connected to the base; the horizontal extension portion is formed on the front of the straight portion.

* * * * *